US008596980B2

(12) United States Patent
Miller

(10) Patent No.: US 8,596,980 B2
(45) Date of Patent: Dec. 3, 2013

(54) VIBRATION DAMPER ASSEMBLY

(75) Inventor: David Miller, Nottingham (GB)

(73) Assignee: Rolls-Royce PLC (GB)

( * ) Notice: Subject to any disclaimer, the term of this patent is extended or adjusted under 35 U.S.C. 154(b) by 947 days.

(21) Appl. No.: 12/699,157

(22) Filed: Feb. 3, 2010

(65) Prior Publication Data

US 2010/0202888 A1 Aug. 12, 2010

(30) Foreign Application Priority Data

Feb. 10, 2009 (GB) ..... 0902032.2

(51) Int. Cl.
*F01D 5/26* (2006.01)

(52) U.S. Cl.
USPC ..... 416/190; 416/500

(58) Field of Classification Search
USPC ..... 415/173.1, 139, 119; 416/189, 190, 500
See application file for complete search history.

(56) References Cited

U.S. PATENT DOCUMENTS

| | | | | |
|---|---|---|---|---|
| 2,912,223 | A * | 11/1959 | Hull, Jr. | 416/221 |
| 3,752,599 | A * | 8/1973 | Pace | 416/190 |
| 3,986,792 | A * | 10/1976 | Warner | 416/190 |
| 4,815,938 | A | 3/1989 | Brown | |
| 5,730,584 | A * | 3/1998 | Dodd | 416/190 |
| 5,984,638 | A | 11/1999 | Gresh et al. | |
| 6,371,727 | B1 * | 4/2002 | Stangeland et al. | 416/190 |
| 7,887,286 | B2 * | 2/2011 | Abgrall et al. | 415/119 |

FOREIGN PATENT DOCUMENTS

| | | |
|---|---|---|
| GB | 1503453 | 10/1976 |
| GB | 2449493 A | 11/2008 |
| JP | 05039701 | 2/1993 |
| JP | 7091206 A | 9/1993 |

OTHER PUBLICATIONS

"Application of shape memory alloy in civil structures", Engineering Structure 28 2006 pp. 1266-1274.*

* cited by examiner

*Primary Examiner* — Ninh H Nguyen
(74) *Attorney, Agent, or Firm* — McCormick, Paulding & Huber LLP

(57) ABSTRACT

A vibration damper assembly is provided between two shrouds of adjacent turbine blades. A pair of confronting passages are provided, one in each of the shrouds and a vibration damper is located in both of the confronting passages. The vibration damper comprises a structure which when heated expands outwardly so as to engage with the walls of the passages. The vibration damper may be a sheet metal shape memory nickel base alloy wound into an open spiral and provided in circular cross-section passages.

18 Claims, 4 Drawing Sheets

VIBRATION DAMPER ASSEMBLY

CROSS REFERENCE TO RELATED APPLICATION

This application is entitled to the benefit of British Patent Application No. GB 0902032.2, filed on Feb. 10, 2009.

FIELD OF THE INVENTION

This invention relates to vibration damper assemblies, vibration damper assemblies usable between turbine shrouds of a gas turbine engine, a turbine assembly incorporating such vibration damper assemblies, and also a gas turbine engine incorporating one or more such turbine assemblies.

BACKGROUND OF THE INVENTION

Gas turbine engines commonly include an axial flow turbine that comprises at least one annular array of radially extending aerofoil blades mounted on a common disc. Each aerofoil blade is sometimes provided with a shroud at its radially outer tip so that the shrouds of adjacent blades cooperate to define a radially outer circumferential boundary to the gas flow over the aerofoil blades.

In operation, there can be a tendency for the gas flows over the aerofoil blades to cause the blades to vibrate to such an extent that they require some degree of damping. One way of achieving such damping is to interconnect the shrouds of the blades with a single length of wire that passes through appropriate circumferentially extending passages provided in the shrouds. Any vibration of the blades results in relative movement between their shrouds and hence between the passages and the wire. Friction between the passage walls and the wire tends to dampen such relative movement, and hence the blade vibration. Such an arrangement is described and shown in Swiss Patent No. 666326. The drawback with this type of arrangement, however, is that the wire adds undesirable weight to the blade assembly.

EP0806545B1 discloses a damper for damping non-synchronous vibration in adjacent shrouded aerofoil blades in the form of pin that locates in confronting passages in adjacent blade shrouds. The pin is provided with larger diameter portions that are located totally within the passages and frictionally engage the surfaces of the passages to provide vibration damping. The pin is circular in cross section and the larger diameter pin portions are interconnected by a central, thinner portion. The configuration of the pin reduces the likelihood of it wearing in such a manner that it jams in the passages and no longer provides vibration damping. However, during engine running the damper experiences excessive wear resulting in loss of material and a reduction in damper mass. Due to the small size of the damper, this mass loss constitutes a significant proportion of its mass. The reduction in damper mass causes damping effectiveness to be compromised with time, and can result in an in service failure.

SUMMARY OF THE INVENTION

According to the present invention there is provided a vibration damper assembly, the assembly including a vibration damper located in both of a pair of generally confronting passages, the passages being provided respectively in adjacent components, the vibration damper including a structure which when heated expands outwardly so as to engage with the walls of the passages.

The structure may initially be compressed prior to insertion into the component passages.

The structure may be in the form of a spiral, and may be a spiral of a sheet material, which spiral may be curved about a transverse direction of an elongate sheet.

The passages may be substantially circular in cross section.

In an alternative arrangement the structure may have a pleated configuration. The pleated configuration may include sheets of material interconnected to respective adjacent sheets along opposite side edges.

The passages may be substantially rectangular in cross section.

The structure may be made of a shape memory alloy.

The structure may be made of a nickel based alloy.

The invention also provides a vibration damper assembly usable between turbine shrouds of a gas turbine engine.

The invention moreover provides a turbine assembly for a gas turbine engine, the assembly including a vibration damper assembly according to the above paragraph between each adjacent pair of turbine blades.

The invention yet further provides a gas turbine engine incorporating one or more turbine assemblies according to the above paragraph.

DETAILED DESCRIPTION OF THE PREFERRED EMBODIMENTS

Figure 1:
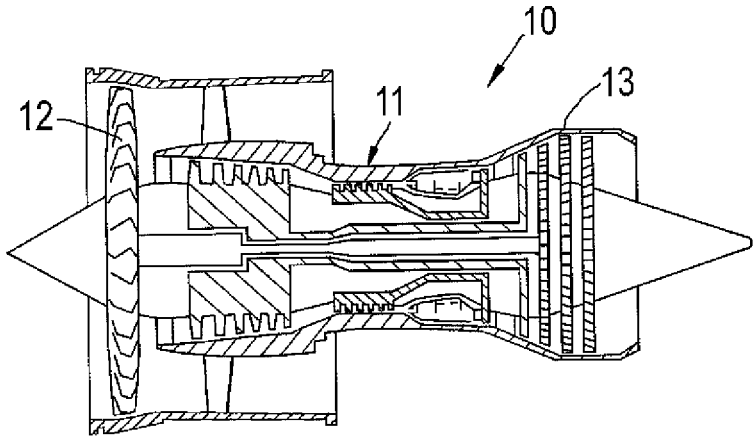
FIG. 1 is a simplified sectioned side view of a gas turbine engine incorporating the present invention.

With reference to FIG. 1, a ducted fan gas turbine engine generally indicated at 10 is of generally conventional configuration and operation. It comprises a core unit 11 which services to drive a propulsive ducted fan 12 and also to provide propulsive thrust. The core unit 11 includes a low pressure turbine 13 which comprises three rotary stages of aerofoil blades.

Figure 2:
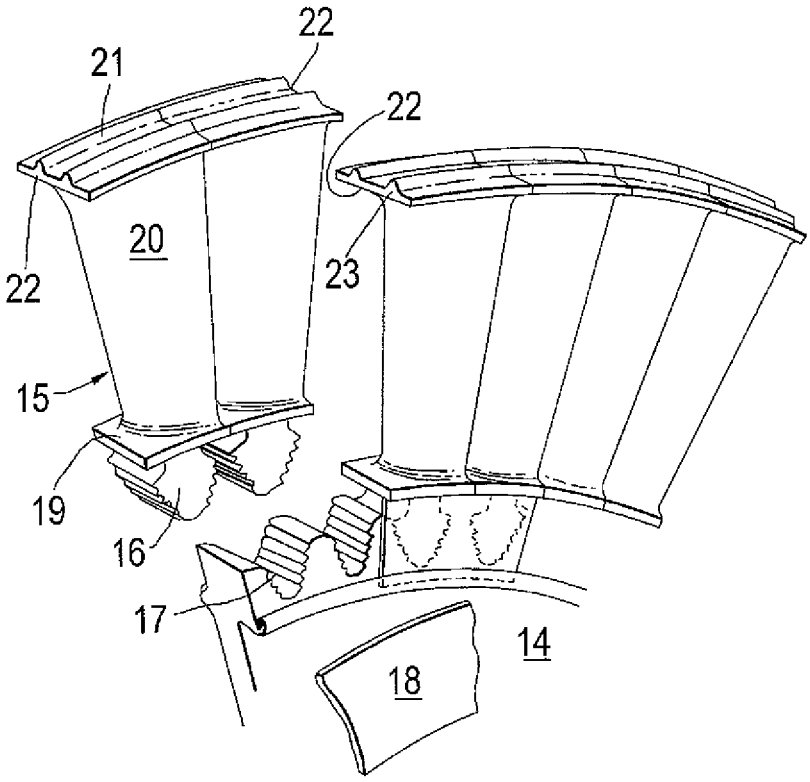
FIG. 2 is a partially exploded view of part of the turbine of the gas turbine engine shown in FIG. 1.

Part of one of those low pressure turbine stages can be seen in FIG. 2. It comprises a disc 14 having a plurality of similar radially extending aerofoil blades 15 mounted on its periphery. Each aerofoil blade 15 is preferably formed from a suitable nickel base alloy and has a conventional fir tree cross-section root 16 which locates in a correspondingly shaped slot 17 provided in the disc 14 periphery. The configuration of the root 16 ensures radial constraint of its corresponding aerofoil blade 15 whilst permitting the root 16 to be slid axially into its corresponding slot 17 in the disc periphery for assembly purposes. Suitable stops (not shown) and seal plates 18 which are subsequently attached to the disc 14 and aerofoil blades 15 ensure the axial retention of the aerofoil blades 15 on the disc.

In addition to having a root 16, each aerofoil blade 15 comprises an inner platform 19 positioned adjacent the root 16, an aerofoil portion 20 extending radially outwardly from the inner platform 19 and a shroud 21 positioned on the radially outer extent of the aerofoil portion 20. The inner platforms 19 of adjacent aerofoil blades 15 cooperate to define a radially inner boundary to the gas path over the aerofoil portions 20. Similarly, the shrouds 21 of adjacent aerofoil blades 15 cooperate to define a radially outer boundary to the gas path over the aerofoil portions 20.

Each of the inner platforms 19 and outer shrouds 21 is circumferentially spaced apart by a small distance from its adjacent platform 19 or shroud 21. This is to allow for the vibration of the aerofoil blades 15 which inevitably occurs when gases flow over them during operation of the engine 10. It is this gas flow which causes the aerofoil blades 15 to rotate the disc 14 upon which they are mounted.

Excessive aerofoil blade vibration is usually looked upon as being undesirable since it can lead to premature component failure through cracking. The present invention is concerned with the damping of vibration in order to avoid such premature component failure.

Figure 3:
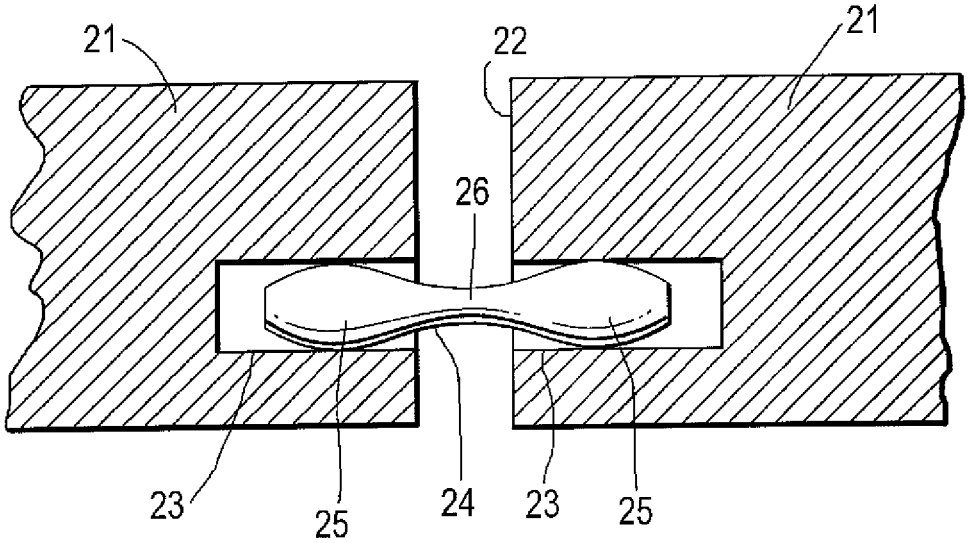
FIG. 3 is a section through adjacent shrouds of turbine blades including a prior art vibration damper.

In EP0806545 vibration damping is provided by dampers that are associated with each of the shrouds 21. Each shroud 21 is provided at each of its circumferential edges 22 with a blind circumferentially extending circular cross section passage 23. Each passage 23, as can be seen more clearly in FIG. 3, confronts the passage in the adjacent shroud 21. Each pair of confronting shroud passages 23 contains a damper 24 which is in the form of a metallic pin interconnecting the adjacent shroud passages 23. The pin 24, which is preferably formed from a nickel base alloy, is of circular cross sectional configuration and has portions that are of greater diameter than other portions. More specifically, the pin 24 has two similar larger diameter portions 25 that are interconnected by a small diameter portion 26.

Additionally the pin 24 diameter varies progressively from its smaller diameter central portion 26 to each of its larger diameter portions 25 and thence decreases to each of its ends.

The greatest circumference part of each larger diameter pin portion 25 is so positioned on the pin 24 that each of the portions 25 of the pin 24 that engages the internal wall of its associated shroud passage 23 is totally contained within that passage 23.

If the aerofoil blades 15 are subject in use to non-synchronous vibration, there will be relative movement between the blades 15. Since the aerofoil blades 15 are attached to the disc 14 at their radially inner extends, that relative movement tends to be of greatest magnitude in the region of the blade shrouds 21. The vibration is likely to be in one or both of the two main modes: flutter and torsional oscillation. Notwithstanding the particular mode or modes involved, vibration of the blades 15 results in adjacent shrouds 21 moving relative to each other in both circumferential and axial directions (with respect to the longitudinal axis of the engine 10). Such relative shroud 21 movement results in the pins 24 sliding within the passages 23. This sliding movement is resisted by friction between the walls of the passages 23 and those portions of the pins 24 that engage those walls, thereby providing damping of the movement. The pins 24 therefore provide damping of non-synchronous vibration of adjacent aerofoil blades 15.

Figure 4:
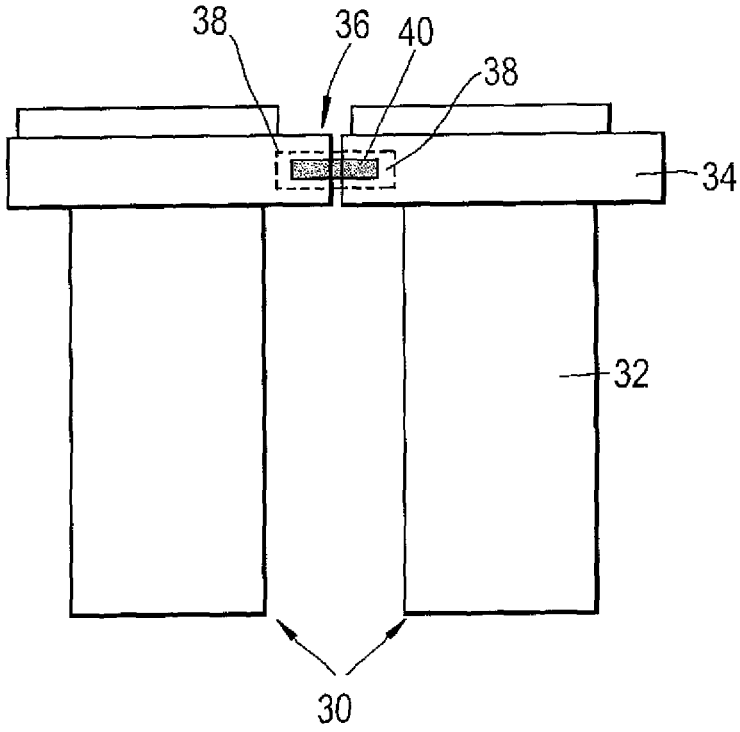
FIG. 4 is a diagrammatic side view of a damper assembly according to the invention extending between two turbine blades.
Figure 5:
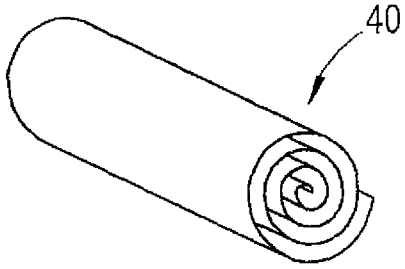
FIG. 5 is a perspective view of a first vibration damper according to the invention.

FIG. 4 shows two adjacent turbine blades 30 each with an aerofoil 32 and an outer shroud 34. A vibration damper assembly 36 is provided between the two shrouds 34. The assembly 36 includes a pair of confronting passages 38 one in each of the shrouds 34. A vibration damper 40 (FIG. 5) is provided located in each of the passages 38 and extending therebetween.

The damper 40 comprises an open spiral structure formed from a sheet of a shape memory nickel based alloy, with the spiral being wrapped around the transverse direction of an elongate sheet. To locate the damper 40 in the passages 38 it is compressed to have an outer circumference which is less than the inner diameter of the passages 38. The compressed damper 40 is located cold into the passages 38.

Figure 6A:
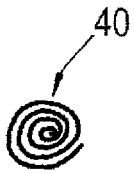
FIGS. 6A and 6B are diagrammatic end views of the damper of FIG. 4 in respectively cold and heated conditions.
Figure 6B:
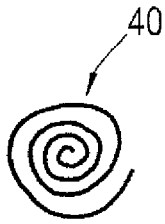

In use, the heat in the turbine will cause the damper 40 to expand to engage the inner walls of the passages 38, and provide a damping effect. As and when the damper 40 becomes worn, the structure thereof will simply expand outwardly a little more due to the heat in the turbine, and therefore to maintain its damping effect. The expansion of the damper 40 can be seen in FIGS. 6A and 6B, where FIG. 6A is the damper 40 when cold, and heat in the turbine urges the damper to unroll as shown in FIG. 6B.

Figure 7:
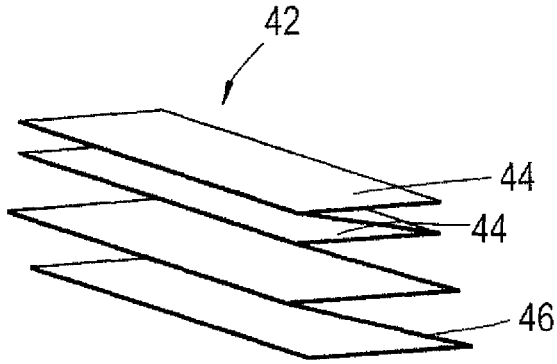
FIG. 7 is a diagrammatic perspective view of a second vibration damper according to the invention.
Figure 8A:
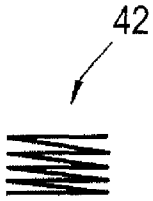
FIGS. 8A and 8B are respectively diagrammatic end views of the second damper of FIG. 7 in respectively cold and heated conditions.
Figure 8B:
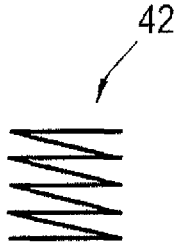

FIGS. 7, 8A and 8B show a second alternative damper 42. In this instance the damper 42 is made from a number of sheets 44 of a nickel base shape memory alloy in a pleated configuration. Alternate sheets 44 are provided generally parallel to each other, with further sheets 46 extending diagonally therebetween. The sheets 46 extend between opposite side edges of the alternate sheets 44.

The damper 42 can be used in a similar manner to the damper 40, with the damper 42 being compressed before insertion in the passages 38. For use with the first damper 40 the passages 38 will generally have a circular cross section, whilst for use with the damper 42 the passages may have a rectangular configuration. FIGS. 8A and 8B show expansion of the damper 42 upon heating, with the pleated stack of sheets 44, 46 tending to expand outwardly.

There is thus described a vibration damper assembly where the damper automatically expands with heat in the respective passages, and therefore as the damper is worn the structure of the damper will expand to maintain engagement with the walls of the passages. This helps to overcome the problems encountered previously with dampers where as the dampers have worn this has overtime reduced their damping effectiveness and can eventually result in a failure in service.

The dampers of the present invention are still of relatively straightforward construction and thus can be inexpensively produced for operation in a conventional manner.

Various other modifications may be made without departing from the scope of the invention. For instance, whilst the vibration damper assembly described above is for use with turbine shrouds, assemblies according to the invention could be used in a wide range of different applications. The damper may take a different form to those described. The damper may be made of different materials.

What is claimed is:

1. A vibration damper assembly for adjacent turbine blades, each turbine blade comprising an aerofoil and a shroud, the vibration damper assembly being provided between shrouds of a pair of adjacent turbine blades and comprising:

a vibration damper located in both of a pair of generally confronting passages, each passage being provided respectively in the shroud of one of the pair of adjacent turbine blades, the vibration damper including a compressible structure in a compressed state in the passages, and, when heated, the compressible structure expands outwardly so as to engage with the walls of the passages.

2. An assembly according to claim 1, wherein the compressible structure is initially compressed prior to insertion into the component passages.

3. An assembly according to claim 1, wherein the compressible structure is in the form of a spiral.

4. An assembly according to claim 3, wherein the compressible structure is in the form of a spiral of a sheet material.

5. An assembly according to claim 4 wherein the compressible structure is in the form of a spiral curved about a transverse longitudinal direction of an elongate sheet.

6. An assembly according to claim 1, wherein the passages are substantially circular in cross section.

7. An assembly according to claim 1, wherein the compressible structure has a pleated configuration.

8. An assembly according to claim 7, wherein the pleated configuration includes sheets of material interconnected to respective adjacent sheets along opposite side edges.

9. An assembly according to claim 7, characterised in that the passages are substantially rectangular in cross section.

10. An assembly according to claim 1, characterised in that the compressible structure is made of a shape memory alloy.

11. An assembly according to claim 1, wherein the compressible structure is of a nickel based alloy.

12. A vibration damper assembly as claimed in claim 1 wherein each confronting passage is provided in a circumferential edge of the respective shroud, extends circumferentially in the respective shroud, and is substantially circular in cross-section and the axis of each passage extending circumferentially.

13. A vibration damper assembly provided between adjacent turbine blades, which have shrouds, with each shroud defining one of a pair of confronting passages, the confronting passages having a common cross-section selected from the group consisting of a circular cross-section or a rectangular cross-section, the vibration damper assembly comprising:

a vibration damper located in both of the confronting passages, the vibration damper comprises a compressible structure that has a shape selected from the group consisting of a spiral form and a pleated structure and that is in a compressed state in the passages whereby when heated the compressible structure expands outwardly so as to engage with the walls of the passages.

14. A turbine assembly for a gas turbine engine, the assembly including a vibration damper assembly according to claim 13 between each adjacent pair of turbine blades.

15. A gas turbine engine further comprising one or more turbine assemblies according to claim 14.

16. A vibration damper assembly according to claim 13 wherein the compressible structure comprises a shape memory alloy.

17. A vibration damper assembly for adjacent turbine blades, each turbine blade comprising an aerofoil and a shroud, the vibration damper assembly being provided between the shrouds of adjacent turbine blades, the vibration damper assembly comprising:

a vibration damper located in both of a pair of generally confronting passages, each passage being provided in a shroud of a respective one of the turbine blades, the passages being substantially circular in cross-section, the vibration damper comprising a compressible structure, the compressible structure being in a compressed state in the passages, the compressible structure being in the form of a spiral, the vibration damper being made of shape memory alloy whereby the compressible structure expands outwardly when heated so as to engage with the walls of the passages.

18. A vibration damper assembly for adjacent turbine blades, each turbine blade comprising an aerofoil and a shroud, the vibration damper assembly being provided between the shrouds of adjacent turbine blades, the vibration damper assembly comprising:

a vibration damper located in both of a pair of generally confronting passages, each passage being provided in a shroud of a respective one of the turbine blades, the passages being substantially rectangular in cross-section, the vibration damper comprising a compressible structure, the compressible structure being in a compressed state in the passages, the compressible structure being in the form of pleated structure, the vibration damper being made of shape memory alloy whereby the compressible structure expands outwardly when heated so as to engage with the walls of the passages.

* * * * *